United States Patent [19]

Mendenhall

[11] 4,398,826

[45] Aug. 16, 1983

[54] ASPHALTIC CONCRETE RECYCLING APPARATUS

[76] Inventor: Robert L. Mendenhall, 1770 Industrial Rd., Las Vegas, Nev. 89102

[21] Appl. No.: 293,284

[22] Filed: Aug. 17, 1981

Related U.S. Application Data

[63] Continuation-in-part of Ser. No. 139,640, Apr. 14, 1980, Pat. No. 4,326,809, and a continuation-in-part of Ser. No. 180,297, Aug. 22, 1980, abandoned.

[51] Int. Cl.[3] ..... B28C 5/42; B28C 5/46

[52] U.S. Cl. ..... 366/25; 366/57; 366/228; 366/231; 432/72; 432/105

[58] Field of Search ..... 366/4, 5, 7, 231, 11, 366/12, 21, 24, 25, 52, 57, 58, 187, 188, 192, 193, 225, 228, 184, 22, 23; 432/72, 73, 105–110; 34/108, 109, 122, 124, 128, 132, 134, 137

[56] References Cited

U.S. PATENT DOCUMENTS

| | | | |
|---|---|---|---|
| 2,421,345 | 5/1947 | McConnaughay | 366/25 |
| 3,407,511 | 10/1968 | Camm | 432/110 |
| 3,840,215 | 10/1974 | McConnaughay | 366/25 |
| 4,130,364 | 12/1978 | Brown | 366/25 |
| 4,136,965 | 1/1979 | Sunnergren et al. | 366/228 |
| 4,165,184 | 8/1979 | Schlarmann | 366/228 |
| 4,208,131 | 7/1980 | Mendenhall | 432/105 |

*Primary Examiner*—Philip R. Coe
*Assistant Examiner*—Timothy F. Simone
*Attorney, Agent, or Firm*—Seiler & Quirk

[57] ABSTRACT

An improved asphaltic concrete recycling apparatus comprises an elongated drum having an open inlet port at a first drum end and a product recovery port adjacent a second and opposite drum end, a burner adjacent the first drum end for introducing hot gases of combustion into the inlet port, and an elongated sleeve extended along the interior of the drum intermediate the first and second ends for directing the hot gases of combustion toward the second drum end. In the preferred embodiment, the first end of the sleeve is located in a portion of the drum where a veil of composition is avoided during drum rotation, and the second sleeve end is located in a drum portion where a curtain or veil of composition is formed.

10 Claims, 2 Drawing Figures

ASPHALTIC CONCRETE RECYCLING APPARATUS

REFERENCE TO OTHER APPLICATIONS

This application is a continuation-in-part of my co-pending applications Ser. No. 139,640, filed Apr. 14, 1980, now U.S. Pat. No. 4,326,809 and Ser. No. 180,297, filed Aug. 22, 1980, ABND.

BACKGROUND OF THE INVENTION

In my aforesaid co-pending applications, there is disclosed an improved apparatus for recycling asphaltic concrete comprising an elongated drum having a large open port at one end into which flame and hot gases of combustion are introduced for heating asphalt-aggregate composition as the drum is rotated. The use of such an apparatus is particularly advantageous since product is recovered at the opposite end of the drum through a port, which is normally closed, except to the extent necessary for product recovery. Because the apparatus is substantially closed, except at the large open inlet port, when heating asphalt containing materials in the drum, volatile asphaltic hydrocarbons in the drum are burned, and these gaseous materials, together with the exhaust gases, are vented to atmosphere substantially only through the open port, concurrently with the introduction of the heating gases. Although such an apparatus is quite efficient, and especially so in recycling used asphaltic concrete, it has been found that larger particles of the material at the recovery end are often not heated enough to become softened and broken up as the drum is rotated because they continually transfer heat to the smaller particles of material in the mixture. Due to their size, the larger pieces do not pass through the particle size limiting screens and thus accumulate in the drum. A significant cause of heating problems in the drum is that the mass of cascading materials form a substantial veil throughout the cross-section of the drum interior thereby preventing the hot gases from penetrating deeply to the opposite drum end. It is to the elimination of the problem that the present invention is directed.

SUMMARY OF THE INVENTION

The apparatus of the present invention includes an elongated sleeve extending interiorly of the drum intermediate the large open inlet port at the first drum end, and the opposite end at which heated product is recovered. The sleeve provides a conduit or passageway for directing the hot gases of combustion entering the inlet end of the drum to the product recovery end thereby substantially improving heat transfer along the drum length.

DETAILED DESCRIPTION OF THE INVENTION

Figure 1:
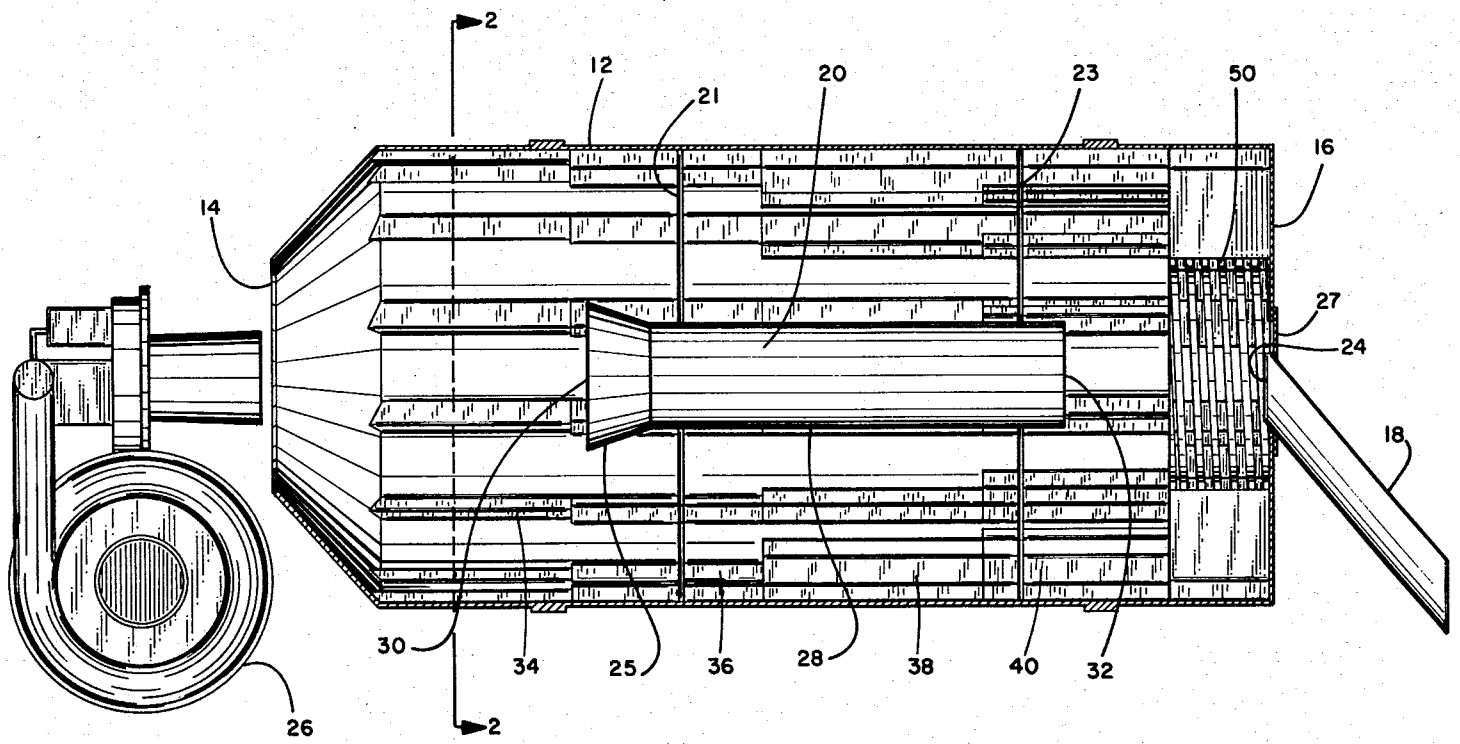
FIG. 1 is a side sectional view of the apparatus of the invention illustrating the improvement.
Figure 2:
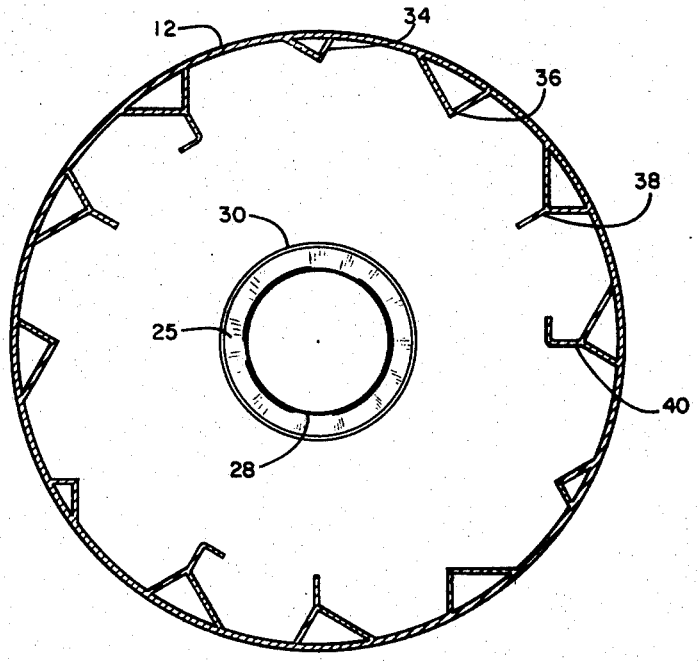
FIG. 2 is a sectional view taken along lines 2—2 of FIG. 1.

In FIGS. 1 and 2 there is shown the improved apparatus of the invention comprising an elongated drum 12 having a large inlet port 14 at one end into which hot gases of combustion from burner 26 are directed. The composition, normally used asphaltic concrete particles, is also introduced into the drum through port 14, and heated and mixed inside the drum as it rotates, being gradually drawn toward the opposite end of the drum where the hot composition is recovered. A product recovery port 24 is normally closed by a hinged plate 27 at back plate 16. A chute 18, preferably retractable, extends into port 24 to recover the hot composition. The preferred apparatus including the retractable chute is disclosed in my aforesaid co-pending applications, and is incorporated herein by reference.

The drum also utilizes a plurality of lifters shown in FIG. 2, a variety of different types of which may be used. Those shown include the lower profile or smaller lifter 34, normally present in the forward part of the drum, adjacent inlet port 14. Successively further back in the drum are lifters 36, 38, and 40, these different lifter placements also being fully described in co-pending application Ser. No. 180,297, also incorporated herein by reference. Other lifter patterns may be used to achieve the desired cascading of particulate composition as it is heated in the drum. It will be appreciated that different lifter designs and placements may be desired where drum length:diameter ratios are varied to suit different production rates, capacities, and heating requirements including different types of burners. The apparatus may also include a crusher-feeder for supplying asphalt-aggregate composition to the drum, particularly used asphaltic concrete to be recycled, as described in my co-pending application Ser. No. 180,303 filed Aug. 22, 1980, that description also being incorporated herein by reference.

Regarding the specific improvement of the invention, within the drum is located a long sleeve 28 which extends preferably along the drum axis of rotation intermediate the front and rear, inlet and outlet, ends of the drum. The specific shape of the sleeve is not particularly critical, so long as it is long enough and has a sufficient diameter to adequately direct sufficient hot gases of combustion from the forward end of the drum, adjacent inlet port 14 to the area in the opposite, rear end of the drum. Of course, the diameter of the sleeve may be selected to suit the overall size of the drum, the amount of material to be heated, production rates, and the size and/or type of burner 26 used. Depending on the placement and design of the lifters and the drum length, longer or shorter sleeves may be selected.

Preferably, the sleeve will incorporate an enlarged diameter section 25 at the forward sleeve end, nearest inlet port 14. As shown, frusto-conical shaped section is quite useful. With the larger sized forward end portion 25 of the sleeve adjacent inlet port 14, there is provided a greater sized opening at sleeve edge 30 for directing hot gases into the sleeve.

Sleeve 28 is preferably secured in the drum substantially along the axis of drum rotation so that the hot gases from burner 26 into the center of circular inlet port 14 move directly forward end 30 of the sleeve. It will be understood that if the sleeve is offset relative to the direction in which the hot gases travel into the drum from burner 26, some advantage of the sleeve will be lost. To secure the sleeve, supports 21 and 23 are conveniently attached to the sleeve in the interior surface of the drum in selected positions.

As further illustrated in FIG. 2, different types of lifters may be used along different areas of the drum. Preferably, in one section, toward the forward end of the drum adjacent inlet port 14, the lower lifters 34 and 36, conveniently inverted L or V-shaped ribs, or the like, may be used so that composition in that area is not substantially carried up the side of the drum as it rotates, whereby the formation of a curtain or veil of particles near the flame is avoided. This is important because full exposure of the smaller asphalt containing particles and fines to the flame are to be avoided to prevent asphalt burning. Moreover, the formation of a veil of the cascading of composition also forms a barrier through which the hot gases cannot readily penetrate. A veil being formed substantially between forward edge 30 of the sleeve and inlet port 14 would prevent desirable quantities of the hot gas from entering the sleeve. Accordingly, sleeve 28 is preferably positioned in the drum so that forward edge 30 is in the area or section of the drum having the inverted L or V-shaped ribs or other equivalent ribs which do not have trays or surfaces which substantially lift the composition and allow it to fall to form a veil of particles. Rearwardly from sleeve edge 30, cascading of composition may be provided as desired by using lifters 38 and 40 having much greater surface area or trays for lifting the composition as the drum turns. In this section of the drum, cascading is desirable to expose the particles to the heat. As for the location of back edge 32 of the sleeve relative to drum back plate 16, any position may be selected forwardly of cage 50 which prevents large particles from being recovered through port 24. Thus, the back edge will be located in the area of the drum having tray lifters.

Since the purpose of the sleeve is to direct the hot gases through the veil of cascading composition in the drum, whereby it would otherwise not reach sufficiently to the rear area of the drum, its placement may be advantageously selected to so achieve its desired function. Utilizing the improved apparatus of the invention it has been found that the sleeve allows direction of the hot gases deep into the area of the drum adjacent back plate 16. The result is that large particles which accummulate around that area of the drum become softened sufficiently to break up heated by this direction of hot gases. Moreover, it has been found that with the hot gases carried deep into the drum, the heat distribution is improved, and the process efficiency is increased with the result that exhaust gases from the drum through inlet port 14 are cooler as compared to a drum without the sleeve described herein. These advantages as well as others will be evident to those skilled in the art.

I claim:

1. An elongated rotatable drum having an open inlet port at a first drum end for introducing composition therein, a burner adjacent said first end for introducing hot gases of combustion into said inlet port, a recovery port adjacent a second drum end, closure means for closing said recovery port except to the extent necessary for recovering composition therefrom, and an elongated sleeve entirely within said drum and extending along the drum length intermediate said first and second drum ends for directing a portion of said hot gases toward said second drum end.

2. The drum of claim 1 wherein said sleeve is aligned with said burner along the rotational axis of said drum whereby a portion of said hot gases therefrom are directed into said sleeve.

3. The drum of claim 1 wherein said sleeve comprises a cylindrical tube having a first sleeve end spaced from said first drum end and a second sleeve end spaced from said second drum end and wherein the diameter of said first sleeve end is greater than said second sleeve end.

4. The drum of claim 3 having first lifters extending along a first section of the interior of said drum for substantially preventing a curtain of particulate composition during rotation of said drum, and second lifters extending along a second section of the interior of said drum for creating a substantial curtain of particulate composition during rotation of said drum.

5. The drum of claim 4 wherein first sleeve end is in said first section of said drum and said second sleeve end is in said second end thereof.

6. The drum of claim 5 wherein said first lifters comprise inverted V or L shaped ribs.

7. The drum of claims 5 or 6 wherein said second lifters comprise lifting trays.

8. The drum of claim 3 having a plurality of inverted V or L shaped ribs extending along the drum interior surface in a first section of said drum adjacent said first end, and a plurality of lifting trays in a second section of said drum adjacent said second end, and wherein said first sleeve end is in said first section and said second sleeve end is in said second section.

9. In a rotatable drum for gradually heating particulate composition between an input and output end having an open port at said input end for introducing said composition and for introducing hot gases of combustion, a port at said output end for recovering said composition, and means for maintaining said port at said output end closed except to recover said composition, the improvement comprising means for directing a portion of said hot gases, toward said output end comprising an elongated sleeve entirely within said drum extending along the drum length and spaced substantially from said input and output ends.

10. The drum of claims 3 or 9 wherein said sleeve lies along the axis of drum rotation.

* * * * *